US005671906A

United States Patent [19]

Rosen

[11] Patent Number: 5,671,906

[45] Date of Patent: Sep. 30, 1997

[54] FLUSH VALVE

[76] Inventor: Frank Rosen, 1133 Golden Olive Ct., Sanibel, Fla. 33957

[21] Appl. No.: 569,767

[22] Filed: Dec. 8, 1995

[51] Int. Cl.[6] ..... B08B 9/00

[52] U.S. Cl. ..... 251/148; 440/88; 114/183 R

[58] Field of Search ..... 251/148, 12, 356; 440/88, 113; 114/183 R

[56] References Cited

U.S. PATENT DOCUMENTS 4,121,948 10/1978 Guhlin ..... 440/88 X
5,123,369 6/1992 Gross ..... 440/88 X
5,362,266 11/1994 Brogdon ..... 440/88
5,441,431 8/1995 Brogdon ..... 440/88

*Primary Examiner*—Kevin Lee
*Attorney, Agent, or Firm*—Cammarata & Grandinetti

[57] ABSTRACT

The invention is a flush valve for a water-cooled, marine outboard engine having a flush orifice. The flush valve includes a valve body having an engine attachment end and a flush water source end. The valve body has a channel between the engine end and the source end. The engine end of the valve body can be affixed into the flush orifice of the engine. The flush valve also includes a means for obstructing a discharge flow of cooling liquid from the engine end of the hollow valve body.

1 Claim, 9 Drawing Sheets

FLUSH VALVE

BACKGROUND OF THE INVENTION

1. Field of the Invention

This invention relates to valves. This invention specifically relates to flush valves for use with outboard marine engines.

2. Description of the Background Art

Mechanical engines have been utilized as a source of propulsion for sea and oceangoing vessels for more than one hundred years. The use of small, high powered marine engines with recreational "motorboats" has become especially popular in the second half of the twentieth century.

Most outboard marine engines are water-cooled. For example, outboard marine engines manufactured by Evinrude, Johnson, and Mercury are water-cooled. Seawater is drawn from below the motorboat and circulated through the engine. The circulated water cools the engine and is ejected into the sea. The maintenance of water-cooled outboard motors or engines for motorboats, however, can be costly and time consuming.

Certain elements and compositions in seawater, especially salt water, facilitate the deterioration of engine components. For example, metal components of an engine corrode upon exposure to salt water. Also, salt as well as other minerals in seawater concentrate in recesses and crevices within an outboard motor engine.

The internal surfaces of outboard engines that are operated in salt water must be rinsed with fresh water after each use to prevent saltwater damage. A plug is provided in a threaded flush orifice at the base of many outboard motor engines for this purpose. The plug is removed manually, and the end of a hose is screwed into the orifice. The hose provides fresh water to the internal surfaces of the engine through the orifice to flush salt water and other damaging materials from the engine.

The usual location of the orifice for flushing an outboard engine requires a user to access the base of the engine. Conventional rinsing, therefore, can entail the awkward procedure of leaning over the engine to remove the plug and screw a hose into the orifice. Also, the plug is easily misplaced or accidently dropped into the water upon removal.

Manufacturers of home and garden products provide adaptors to snap-fit a garden hose to a faucet or accessory device. The snap-fitting obviates screwing the hose to the faucet or accessory device. For example, Gardena, Inc., provides a tap connector and a hose connector Model 6917 to connect a garden hose to a faucet. Gardena, Inc., also provides a hose connector Model 6922 to connect a hose to an accessory device, such as a spray gun or a brush. The popularity of such fittings establishes industry standards for hose fittings.

The industry lacks a fitting for flush orifices that both provides a means for plugging an outboard engine at a flush orifice and permits the flushing of the internal surfaces of the engine.

SUMMARY OF THE INVENTION

The invention is a flush valve for a water-cooled outboard marine engine having a flush orifice. The flush valve includes a valve body having an engine end and a source end. The valve body has a channel between its engine end and its source end. The engine end of the valve body has a means for affixing the valve body into the flush orifice. The flush valve also includes a means for obstructing a discharge flow of liquid from the engine end of the hollow valve body through the channel of the valve body.

DETAILED DESCRIPTION OF THE INVENTION

Figure 1:
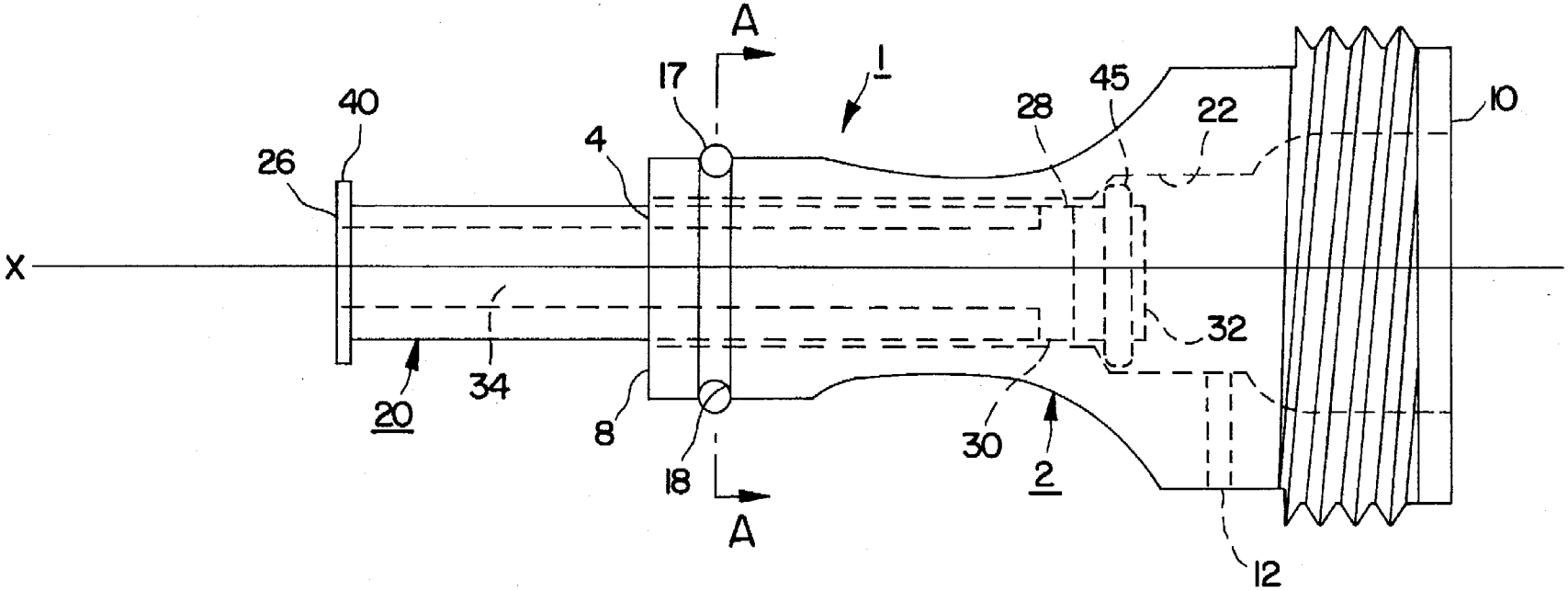
FIG. 1 is an elevational view of a flush valve in a discharge obstructing position in accordance with the preferred embodiment of the invention.

The invention is a flush valve for a water-cooled outboard marine engine having a flush orifice. The flush valve includes a valve body having an engine end and a source end. The valve body has a channel between its engine end and its source end. The engine end of the valve body has a means for affixing the valve body into the flush orifice. The flush valve also includes a means for obstructing a discharge flow of liquid from the engine end of the hollow valve body through the channel of the valve body.

The operation of the invention begins by connecting a supply-liquid hose to the source end of the valve body. Supply liquid flows from the hose through the flush valve and into an interior coolant chamber of the engine. The supply liquid rinses internal surfaces of the engine. The hose is removed and the liquid can drain from the engine when the engine is lifted out of the water. The liquid, under pressure from the engine water pump, actuates the means for obstructing to prevent the discharge of liquid from the interior of the engine through the flush valve.

The flush orifice is provided at or near the bottom of the motorboat engine. The flush orifice is circular and has female threads along an annular surface. Most motorboat engine manufactures provide a flush orifice that couples with a standard garden hose.

The valve body of the preferred embodiment is a tap connector that couples with fittings manufactured by Gardena, Inc. The valve body is elongated and manufactured of a resilient heat-resistant material. The tap connector is preferred because it can be snap-fitted to a hose connector manufactured by Gardena, Inc.

The valve body has an engine end. A cross-section of the engine end of the valve body is larger than a cross-section of the source end of the valve body of the preferred embodiment. The engine end of the valve body is insertable into a standard flush orifice of a water-cooled outboard marine engine.

The valve body has a source end. The preferred embodiment has an O-ring retained in an annular channel in an exterior source at the source end of the valve body. The O-ring provides a tight seal when the valve body is snap-fitted to a Gardena, Inc., hose connector.

The valve body has an interior surface that forms a channel through the valve body. The channel through the valve body provides an aperture at the source end and an aperture at the engine end. The channel of the preferred embodiment includes three substantially circular sections. The diameter of a cross-section of the channel at the source end of the valve body is smaller than the diameter of a cross-section of the channel at the engine end of the valve body.

The valve body of the preferred embodiment has a drainage or inspection port. An inspection port can be provided by a channel that extends from an aperture in the wall of the valve body to the valve body channel. Liquid in the engine cooling chamber and under pressure from the engine water pump flows from the inspection port to indicate proper water pump operation.

A means for affixing or securing the valve body into the flush orifice can be any means for securing the valve body into the flush orifice of the engine. The means for affixing the valve body into the flush orifice of the preferred embodiment includes a threaded male fitting on an exterior surface of the engine end of the valve body. The threaded male fitting is connectable to a threaded female fitting in the flush orifice. Threaded fittings are preferred to secure the valve body into the flush orifice because the threads provide a strong, tight seal while enabling the removal of the valve body from the flush orifice. Alternative embodiments of the means for affixing the valve body into the orifice can include glue, epoxy, pressure fittings, and snap fittings.

A means for obstructing a discharge flow of liquid from an engine, for the preferred embodiment of the invention, includes an elongated valve stem that is coaxial with the channel of the valve body. The means for obstructing a discharge flow of liquid from an engine plugs the flush orifice of the engine to prevent the loss of cooling liquid, such as water, from the cooling chamber. Desirable embodiments of means for obstructing liquid operate by relative pressure so as to automatically plug the flow of liquid through a flush orifice when the pressure of the liquid inside the cooling chamber of an engine or at the engine end of the valve body is greater than the exterior pressure or pressure at the source end of the valve body. Alternative embodiments for means for obstructing a discharge flow of liquid can be manually operated, such as a petcock, or electromechanically operated, such as a valve stem attached to a solenoid.

The valve stem of the preferred embodiment of the engine has a primary aperture at a source end and at least one secondary aperture spaced from a solid engine end of the valve stem. A valve stem channel extends from the primary aperture through the valve stem to the secondary aperture. The valve stem channel has a first section and a second section. The first section extends from the primary aperture along the direction of elongation of the valve stem. The second section diverges from the first section and extends to the secondary aperture. The second section of the valve stem channel can diverge from the first section at any angle. The second section can terminate at one or multiple secondary apertures. The secondary apertures can be in an opposing or a non-opposing configuration to one another.

The valve stem channel can be one of many geometric shapes. For example, a cross-section of the valve stem channel can be a circle, an oval, a square, a rectangle, or another geometric shape. The first and second sections of the valve stem channel can have different shapes. For example, a cross-section of the first section of the valve stem channel can form a circle, while a cross-section of the second section of the valve stem channel can form a square.

The valve stem channel of the preferred embodiment has a second section that is perpendicular to the first section. The second section of the valve stem channel extends between two opposing apertures in a wall of the valve stem. Each of the first section and second section of the valve stem channel has a cross-section that forms a circle. The shape and orientation of the first section and second section of the valve stem channel of the preferred embodiment promote ease of manufacture.

The valve stem of the preferred embodiment of the invention has an annular projection at the source end of the valve stem. The annular projection and the valve stem are formed as a single integral member. The annular projection prevents the source end of the valve stem from passing through the aperture at the source end of the valve body. Alternative valve stems can include any means for stopping the movement of the valve stem through the valve body such as a stopper or projection that engage the valve body.

The valve stem of the preferred embodiment has an annular channel in an exterior surface of the engine end of the valve stem. An O-ring is retained in the annular channel. The O-ring prevents the engine end of the valve stem from passing through the aperture at the source end of the valve body.

The valve stem of the preferred embodiment of the invention has two positions. A first or open position of the valve stem opens the valve body channel so that supply liquid flows through the flush valve into the engine. The annular projection of the valve stem abuts the source end of the valve body. Supply liquid flows through the valve stem channel and out the secondary apertures of the valve stem. A second or closed position of the valve stem closes the valve body channel to prevent discharge liquid from flowing through the flush valve. The O-ring of the valve stem abuts and seals an interior surface of the valve body. The O-ring of the valve stem isolates or seals the secondary apertures of the valve stem from the engine end of the valve body so that liquid in the cooling chamber is prohibited from escaping or passing from the cooling chamber through the flush valve.

The preferred embodiment of the invention includes a valve stem with a smooth exterior surface. The smooth exterior surface permits the valve stem to slide axially along its direction of elongation within the valve body between a first position and a second position. The valve stem is manufactured from a resilient material that can withstand engine operating temperatures. The slidable valve stem of the preferred embodiment operates by pressure. The valve stem slides with the greater pressure at either the source end of the valve stem or the engine end of the valve stem. The valve stem slides automatically axially along its direction of elongation with the greater of the two pressures. The preferred embodiment of the invention is inexpensive and simple to manufacture and reliable to operate. The valve stem channel provides for an ample flow of supply liquid into the engine for flushing the cooling chamber of the engine. The valve stem O-ring structure of the preferred embodiment provides a tight seal and prohibits the discharge of liquid from the cooling chamber of the engine.

A desirable embodiment of the valve stem includes a tertiary aperture at the engine end of the valve stem. At least one quaternary aperture is included between the tertiary aperture and the secondary aperture to provide an inspection or drainage channel. A drainage channel has a relatively small diameter when compared to the diameter of the valve stem channel. The drainage channel is spaced from the valve stem channel and extends to the engine end of the valve stem. The valve stem is otherwise identical to the valve stem of the preferred embodiment. In operation, this alternative valve stem permits liquid to flow from the cooling chamber through the inspection or discharge channel when the valve stem is closed or otherwise obstructing liquid flow from the engine. The alternative embodiment provides visible indication by the small discharge of liquid from the engine, that the engine's water pump is operating properly.

Another alternative embodiment of the valve stem is contoured to rotate about its axis within a valve body between an open position and a closed position. At least one secondary channel in the valve body is contiguous with a secondary aperture at the engine end of the valve stem when the valves stem is in the open position. The secondary channel is not contiguous with the secondary aperture of the valve stem in the closed position. The valve stem is rotated manually by twisting an annular projection or similar means for operating the valve stem.

Another alternative embodiment of the valve stem moves helically along its axis within a valve body between an open position and a closed position. An exterior surface of the valve stem has a threaded male coupling. An interior surface of a valve body has a threaded female coupling that communicates with the threaded male coupling of the valve stem. The alternative embodiment is otherwise identical in structure and operation to the preferred embodiment.

An alternative embodiment of the means for obstructing a discharge flow includes a means for blocking the channel of a valve body. The means for blocking includes a plate within the valve body. The plate has a source end face and an opposing engine end face. The plate has two operable positions. A first or open position of the plate opens the channel of the valve body, and a second or closed position of the plate closes the channel of the valve body. The means for blocking the channel has a means for rotating the plate between the first position and the second position. The means for rotating includes a means for pivoting the plate. The means for pivoting can include a pin or a hinge mechanism at an end of the plate. A means for forcing the plate into the closed position, when the liquid pressure at the source end face of the plate is less than the liquid pressure at the engine end face of the plate, can be included such as a spring, a wedge, or a similar means adjacent the engine end face of the plate. The difference between a liquid pressure at the source end face of the plate and a liquid pressure at the engine end face of the plate actuates the plate between the first and second positions.

An alternative embodiment of the means for blocking the channel is a rotatable disk within a valve body. A face of the rotatable disk has a surface area that is substantially equal to a surface area of a cross-section of a channel of the valve body. The disk has two positions. A first position of the disk opens the channel, and a second position of the disk closes the channel. A pin is connected to the disk and extends from the disk through a watertight fitting in the valve body. The external end of the pin is manually rotated to actuate the disk between the open position and the closed position.

An alternative embodiment of the flush valve includes a means for connecting the valve body to a source of supply liquid such as tap water. The means for connecting the valve body can include any means for forming a watertight seal between the flush valve and the source of supply liquid. The means for connecting the valve body of the preferred embodiment of the invention includes a hose and a Gardena, Inc., hose connector. One end of the hose connector screws into a standard garden hose. Another end of the hose connector snap-fits onto the source end of the valve body. An alternative embodiment of the means for connecting the valve body can be standard, threaded female coupling for a garden hose.

FIG. 1 is an elevational view of a flush valve in a discharge obstructing position in accordance with the preferred embodiment of the invention. The flush valve 1 includes a valve body 2 and a valve stem 20. The valve stem 20 is elongated, located within, and projects axially beyond the source end 8 of the valve body 2. The valve stem 20 is coaxial with an interior surface 22 of the valve body 2. The valve stem 20 is moveable within the valve body 2 along the direction or axis of elongation of the valve stem 20.

Figure 2:
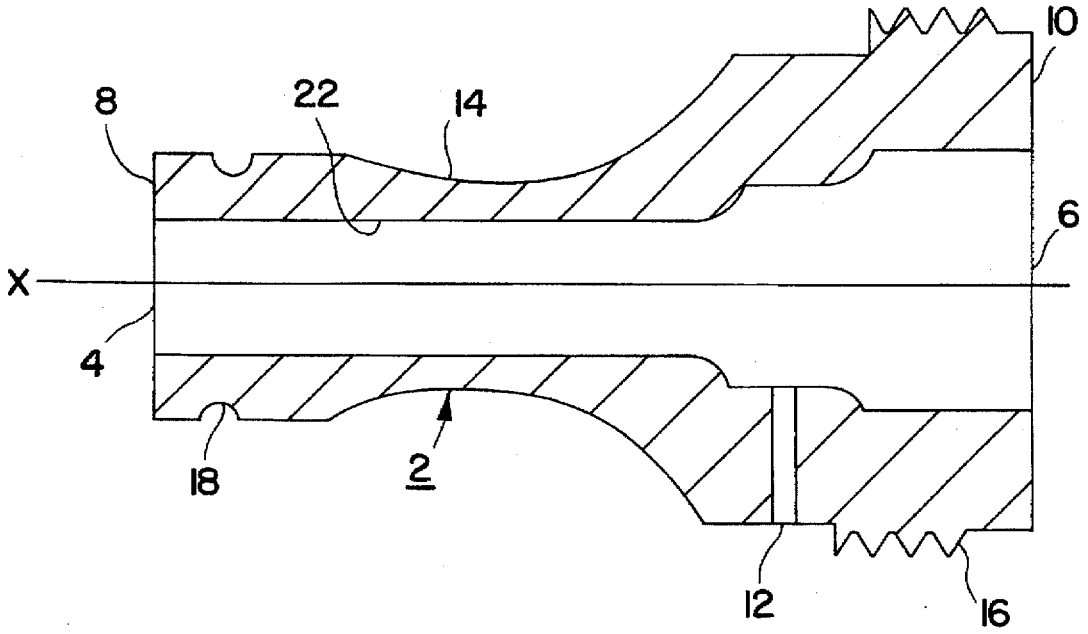
FIG. 2 is a cross-sectional view of the valve body of the flush valve of FIG. 1.

FIG. 2 is a cross-sectional view of the valve body of the flush valve of FIG. 1. The valve body 2 of the preferred embodiment is a tap connector for use with the Gardena, Inc., hose connector Model 6917. The valve body 2 is hollow and elongated and has a first aperture 4 at a source end 8 and a second aperture 6 at an engine end 10. The axis or direction of elongation is parallel with the direction of the channel of this embodiment of the invention. An inspection or drainage port 12 is provided between the source end 8 and the engine end 10 of the valve body 2.

The engine end 10 of the valve body 2 is threaded to be insertable into a flush orifice of a water-cooled, marine outboard engine (not shown). A portion of an exterior surface 14 of the valve body 2 adjacent the engine end 10 is threaded. Valve body threads 16 can communicate with threads on an annular surface of the flush orifice to secure the valve body 2 in the flush orifice.

Figure 3:
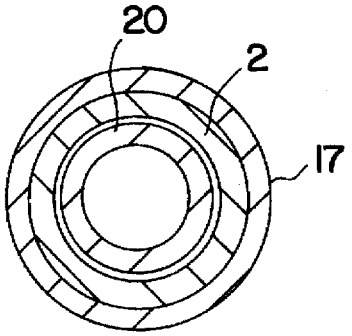
FIG. 3 is a cross-sectional view of the flush valve of FIG. 1 taken along plane A—A.

FIG. 3 is a cross-sectional view of the flush valve of FIG. 1 along plane A—A. The valve body O-ring 17 is rubber and is retained in an annular channel 18 in the exterior surface 14 of the valve body 2 as shown in FIG. 2. A female hose adaptor (not shown) is insertable around the source end 8 of the valve body 2. The valve body O-ring 17 provides a tight seal between an interior surface of the adaptor and the exterior surface 14 of the valve body 2. The adaptor can be attached to a garden hose (not shown).

Figure 4:
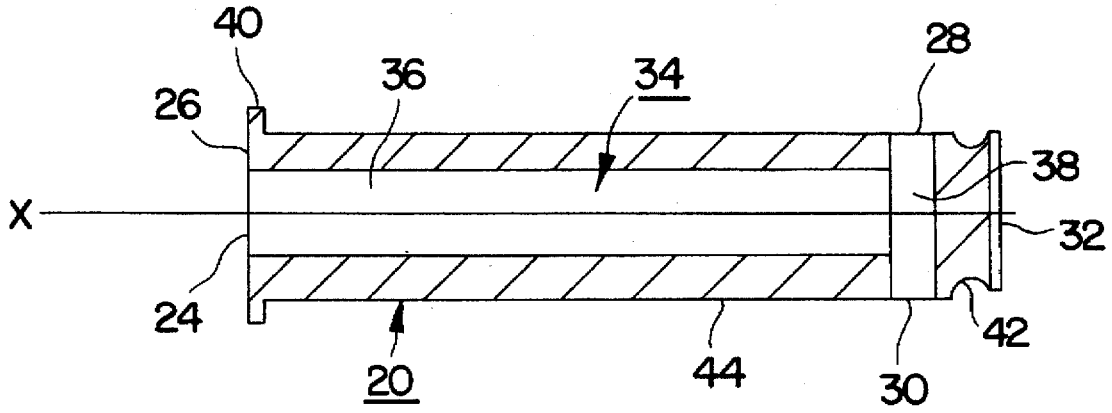
FIG. 4 is a cross-sectional view of a valve stem of the flush valve of FIG. 1.

FIG. 4 is a cross-sectional view of a valve stem of the flush valve of FIG. 1. The valve stem 20 has a primary aperture 24 at its source end 26, and a pair of opposing secondary apertures 28 and 30 spaced from its engine end 32. The valve stem 20 also includes a T-shaped channel 34 having a first section 36 and a second section 38. The first section 36 extends from the primary aperture 24 along the direction of elongation of the valve stem 20. The second section 38 of the T-shaped channel 34 is perpendicular to the first section 36 and connects the two opposing secondary apertures 28 and 30.

An annular projection 40, at the source end 26 of the valve stem 20, extends perpendicular to the direction of elongation of the valve stem 20. The valve stem 20 and the annular projection 40 are formed as a single integral member. The annular projection 40 obstructs the passage of the source end 26 of the valve stem 20 through the first aperture 4 at the source end 8 of the valve body 2.

Figure 5:
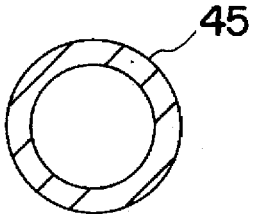
FIG. 5 is a cross-sectional view of a valve stem O-ring of the flush valve of FIG. 1.

FIG. 5 is a cross-sectional view of a valve stem O-ring 45 of the flush valve of FIG. 1. The valve stem O-ring 45 is retained in an annular channel 42 formed in the exterior surface 44 of the valve stem 20 at its engine end 32 as shown in FIG. 4. The valve stem O-ring 45 obstructs the passage of the engine end 32 of the valve stem 20 through the first aperture 4 at the source end 8 of the valve body 2 as shown in FIG. 1. The valve stem O-ring 45 provides a water-tight seal in the interior of the valve body 2 at the first aperture 4 in the discharge obstructing position.

Figure 6:
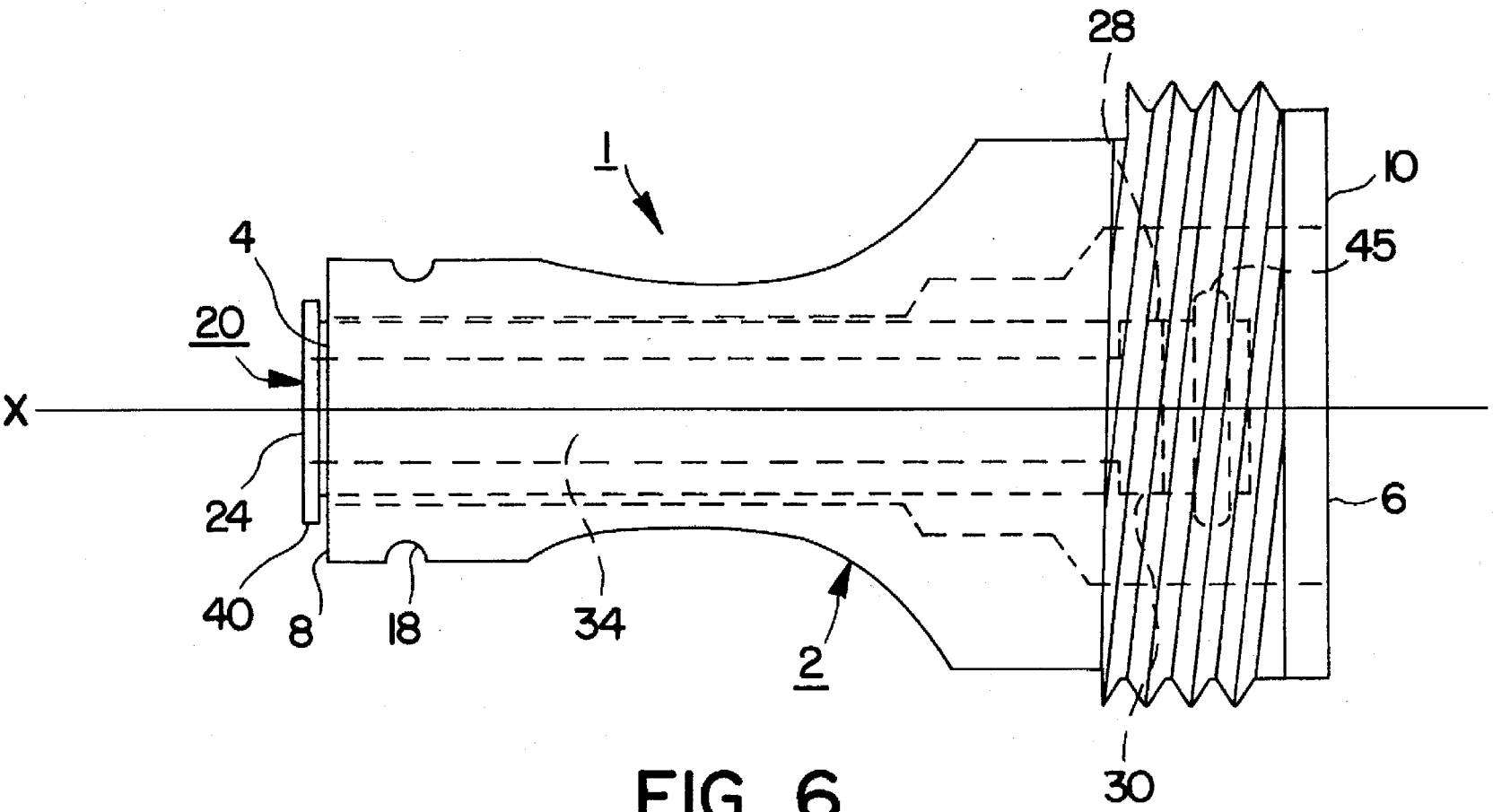
FIG. 6 is an elevational view of the flush valve of FIG. 1 in a flush water supply position.

FIG. 6 is an elevational view of the flush valve of FIG. 1 in a flush water supply position. The valve stem 20 is movable to a position where it is entirely within the valve body 2 except for the annular projection 40. The valve stem O-ring 45 does not seal the interior of the valve body 2 from the first aperture 4 at its source end 8 in the flush water supply position.

The operation of the preferred embodiment begins by connecting a supply liquid or flush water hose to the source end 8 of the valve body 1. The pressure of the liquid supplied by the hose forces the valve stem 20 into the valve body 2 to an open position where the annular projection 40 abuts the source end 8 of the valve body 2, as shown in FIG. 6. The supply liquid flows into the primary aperture 24 of the valve stem 20, through the T-shaped channel 34, and from the secondary apertures 28 and 30. The supply liquid continues through the second aperture 6 at the engine end 10 of the valve body 2 and enters the interior of the engine. The supply liquid rinses internal surfaces of the cooling chamber of the engine.

The hose is removed and the supply liquid or flush water can drain from the engine when the engine is lifted from the water. The operation of the engine circulates cooling liquid, under pressure from an engine water pump, and pushes the valve stem 20 into the "plugged" or discharge obstructing position shown in FIG. 1. The valve stem O-ring 45 prevents water from leaking through the first aperture 4 at the source end 8 of the valve body 2. The valve stem O-ring 45 also prevents the water from entering the T-shaped channel of the valve stem 20. The cooling water flows through the drainage port 12 of the valve body 2 and provides a visual indication of proper water pump operation.

Figure 7:
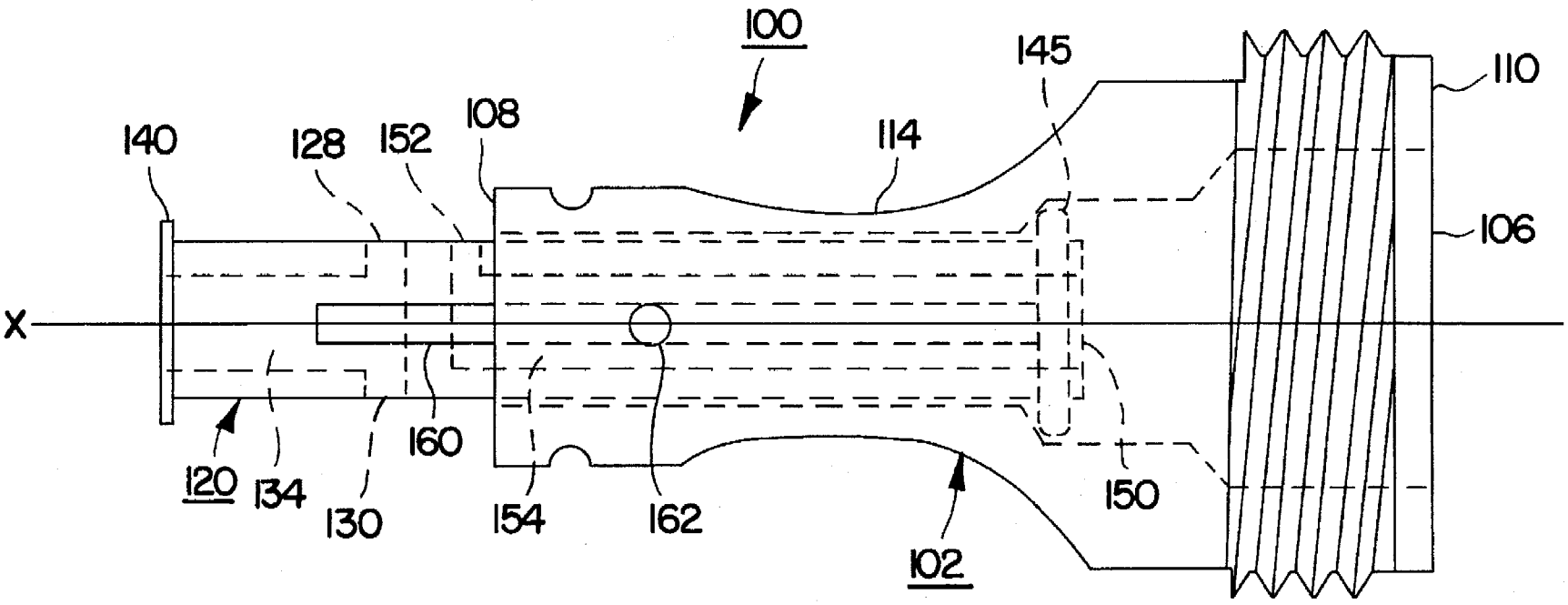
FIG. 7 is an elevational view of a flush valve in accordance with an alternative embodiment of the invention.

FIG. 7 is an elevational view of a flush valve in accordance with an alternative embodiment of the invention. The flush valve 100 includes a valve body 102 with a source end 108, an exterior surface 114, an engine end 110, and inspection port 162, and a valve stem 120.

Figure 8:
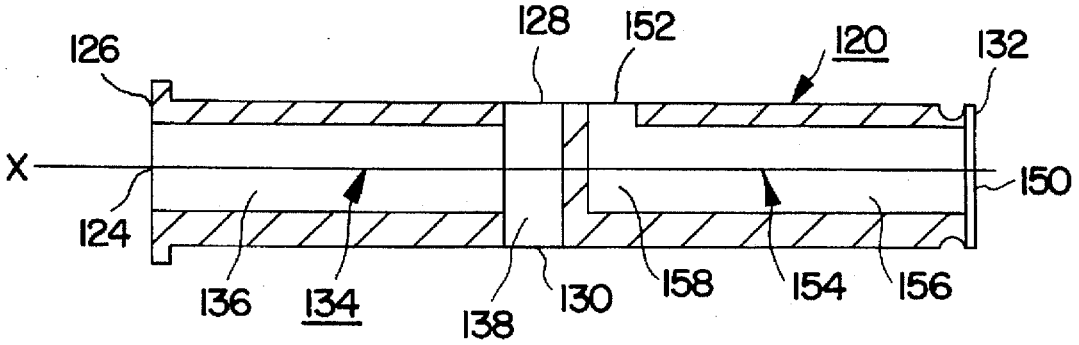
FIG. 8 is a cross-sectional view of a valve stem of the flush valve of FIG. 7.

FIG. 8 is a cross-sectional view of a valve stem 120 of the flush valve of FIG. 7. The valve stem 120 has a primary aperture 124 at its source end 126 and a pair of opposing secondary apertures 128 and 130 spaced from the engine end 132. The valve stem 120 also includes a T-shaped primary channel 134. The T-shaped primary channel 134 has a first section 136 and a second section 138. The first section 136 extends from the primary aperture 124 along the axis or direction of elongation of the valve stem 120. The second section 138 of the channel 134 is perpendicular to the first section 136 and connects the two opposing secondary apertures 128 and 130.

The valve stem 120 has a tertiary aperture 150 at its engine end 132 and a quaternary aperture 152 between the tertiary aperture 150 and the pair of opposing secondary apertures 128 and 130. The valve stem 120 also includes an L-shaped secondary channel 154. The L-shaped secondary channel 154 has a first portion 156 and a second portion 158. The first portion 156 extends from the tertiary aperture 150 along the direction of elongation of the valve stem 120. The second portion 158 diverges from the first portion 156 and extends to the quaternary aperture 152.

Figure 9:
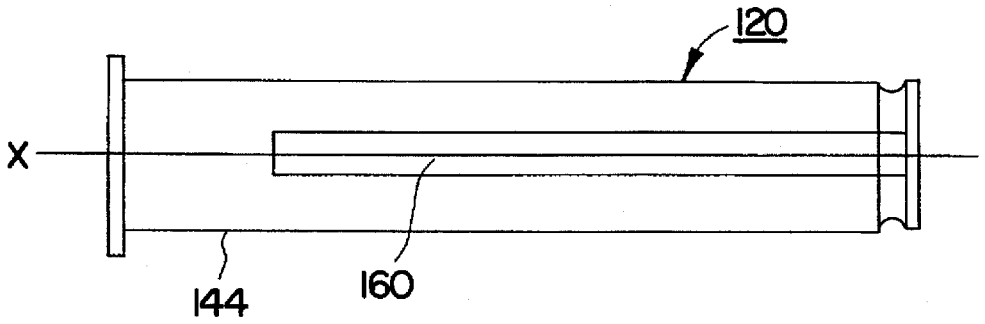
FIG. 9 is an elevational view of the valve stem of FIG. 8.

FIG. 9 is an elevational view of the valve stem of FIG. 8. A channel 160 in the exterior surface 144 of the valve stem 120 extends along its direction of elongation. A pin 162 is attached to the valve body 102, as shown in FIG. 7. The pin 162 extends into the interior of the valve body 102 substantially perpendicular to the direction of elongation of the valve stem 120. The pin 162 communicates with the channel 160 to prevent the valve stem 120 from rotating relative to the valve body 102.

The operation of the alternative embodiment of the flush valve of FIGS. 7, 8, and 9 begins by connecting a supply liquid hose to the source end 108 of the valve body 102. Liquid supplied by the hose forces the valve stem 120 into the valve body 102 to a position where the annular projection 140 abuts the source end 108 of the valve body 102. The liquid flows into the primary aperture 124 of the valve stem 120, through the primary channel 134 of the valve stem 120, and from the secondary apertures 128 and 130. The water continues through the second aperture 106 at the engine end 110 of the valve body 102 and enters the interior of the engine. The supply liquid or flush water can then rinse internal surfaces of the engine.

The liquid, under pressure from an engine water pump, pushes the valve stem 120 into the discharge obstructing position shown in FIG. 7. The valve stem O-ring 145 prevents the liquid from entering the T-shaped primary channel 134 of the valve stem 120. The liquid flows into the tertiary aperture 150, through the L-shaped secondary channel 154, and from the quaternary aperture 152 thereby providing a visual indication of proper water pump operation.

Figure 10:
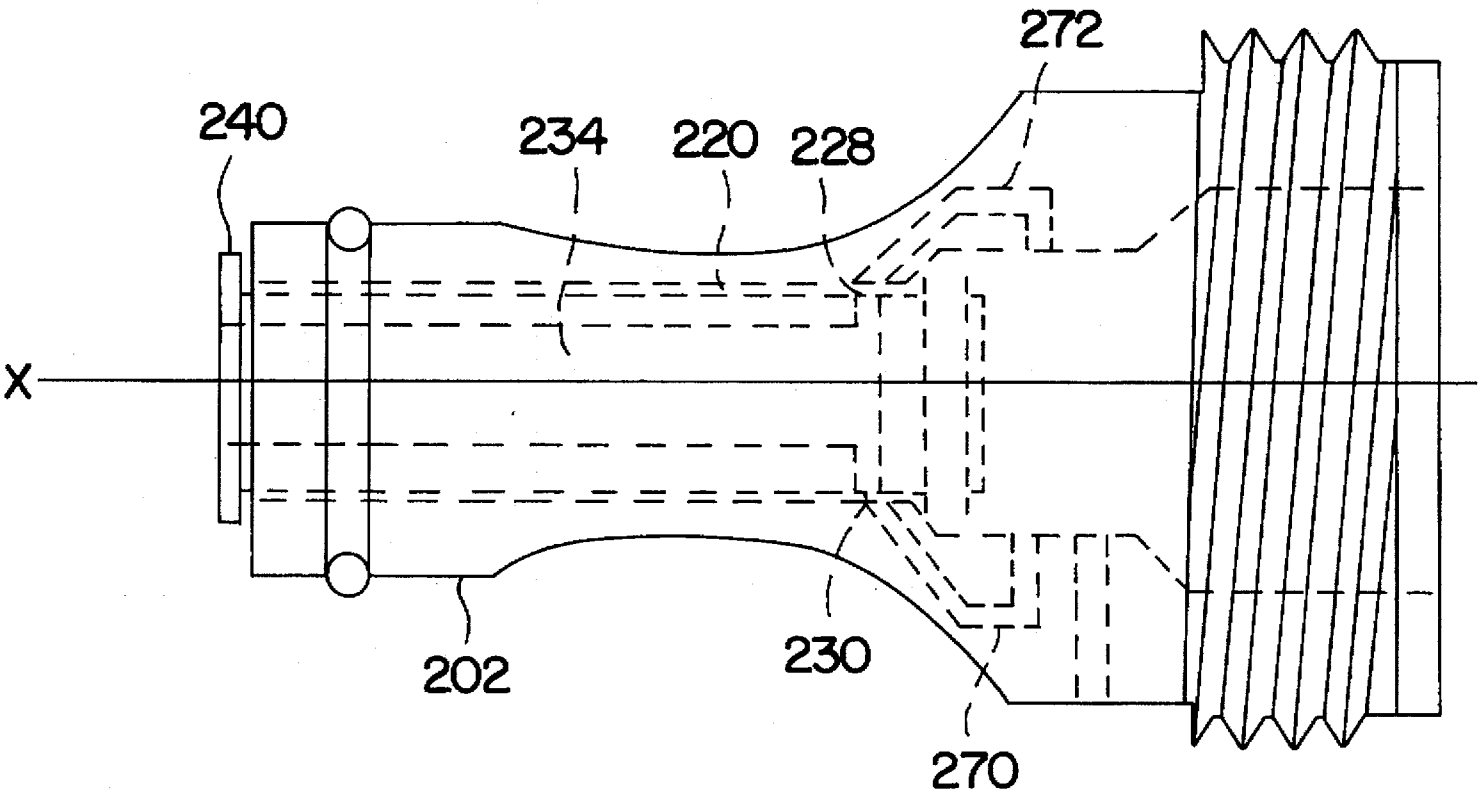
FIG. 10 is a cross-sectional view of a flush valve in accordance with an alternative embodiment of the invention.

FIG. 10 is a cross-sectional view of a flush valve in accordance with an alternative embodiment of the invention. A valve stem 220 is contoured to rotate about its axis within a valve body 202 between a first position and a second position. The valve stem 220 is rotated manually by twisting an annular projection 240 of the valve stem 220.

Secondary channels 270 and 272 in a valve body 202 are contiguous with secondary apertures 228 and 230 of the valve stem 220 in the first or open position. The secondary channels 270 and 272 are not contiguous with the secondary apertures 228 and 230 of the valve stem 220 in the second or closed position. Liquid cannot travel from the secondary channels 270 and 272 of the valve body 202 to the valve stem channel 234 when the valve stem 220 is rotated into the second position.

Figure 11:
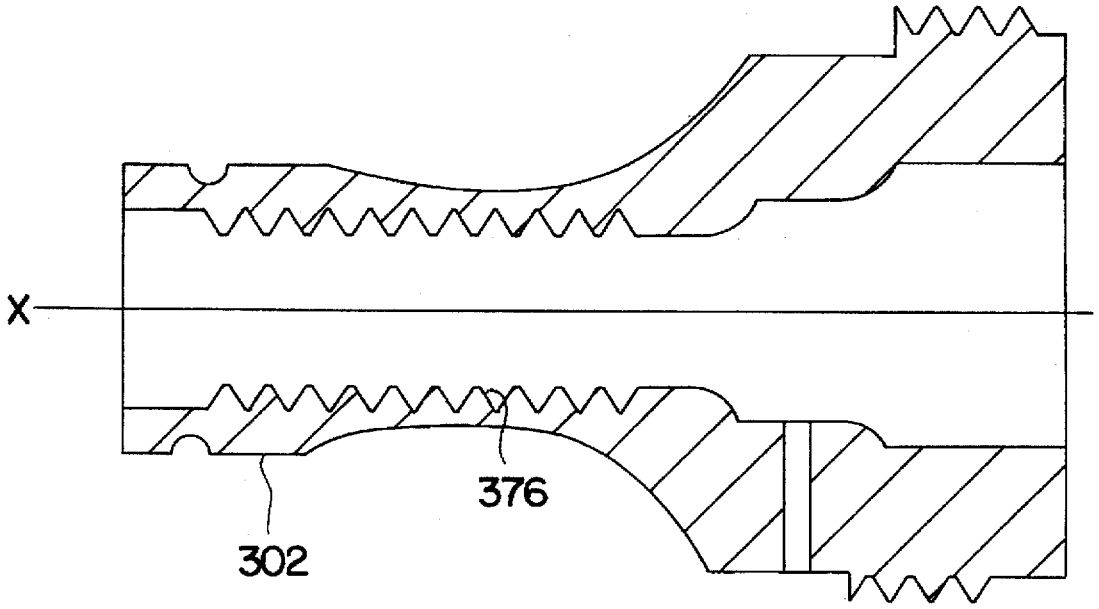
FIG. 11 is an elevational view of a valve body in accordance with an alternative embodiment of the invention.

FIG. 11 is an elevational view of a valve body in accordance with an alternative embodiment of the invention. An interior surface of a valve body 302 has helical grooves 376. The valve body 302 is otherwise identical in structure and function to the valve body 2 of the preferred embodiment.

Figure 12:
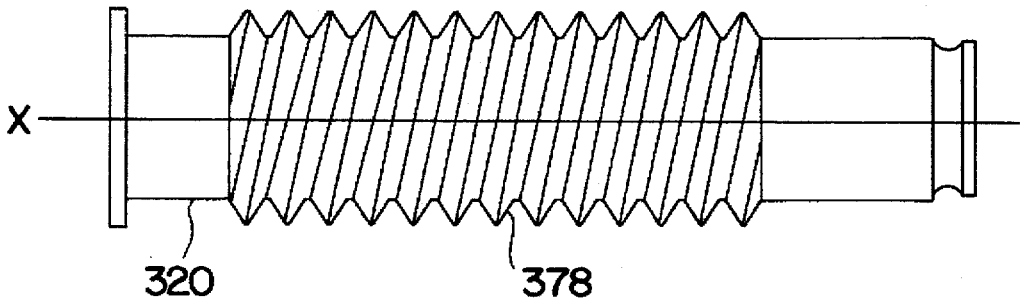
FIG. 12 is an elevational view of a valve stem in accordance with the alternative embodiment of FIG. 11.

FIG. 12 is an elevational view of a valve stem 320 in accordance with the alternative embodiment of FIG. 11. An exterior surface of the valve stem 320 has threads 378. The valve stem 320 is otherwise identical in structural and function to the valve stem 20 of the preferred embodiment.

The valve stem threads 378 communicate with the valve body grooves 376 to move the valve stem 320 helically along its axis within the valve body 302 between first and second positions.

Figure 13:
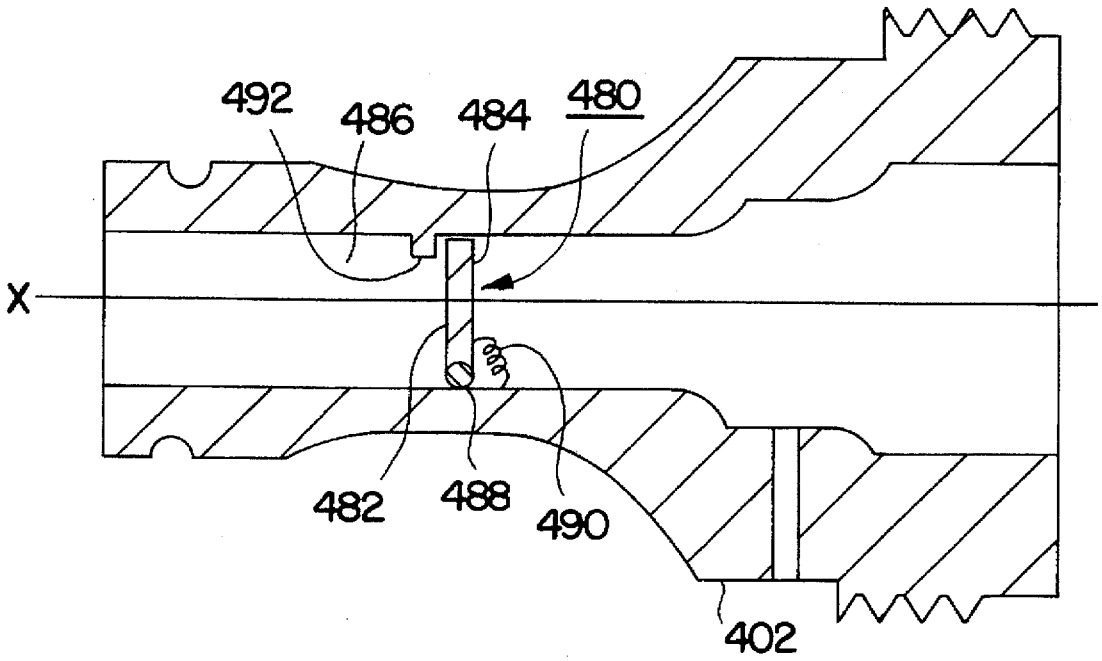
FIG. 13 is a cross-sectional view of a flush valve in accordance with an alternative embodiment of the invention.

FIG. 13 is a cross-sectional view of a flush valve in accordance with a flapper valve alternative embodiment of the invention. A pivotable plate 480 is located within a channel 486 of a valve body 402. The pivotable plate 480 has a source end face 482 and an opposing engine end face 484. The plate 480 has two positions. A first position of the plate 480 opens the valve body channel 486, and a second position of the plate 480 closes the channel 486.

A pin 488 is connected to one end of the plate 480. The pin 488 operates as a hinge so that the difference between a liquid pressure at the source end face 482 of the plate 480 and a liquid pressure at the engine end face 484 of the plate 480 actuates the plate 480 between the first and second positions. A spring 490 forces the plate 480 into the second position when the liquid pressure at the source end face 482 of the plate 480 is less than the liquid pressure at the engine end face 484 of the plate 480. An internal projection 492 holds the plate 480 in the first position when the liquid pressure at the source end face 482 of the plate 480 is greater than the liquid pressure at the engine end face 484 of the plate 480.

Figure 14:
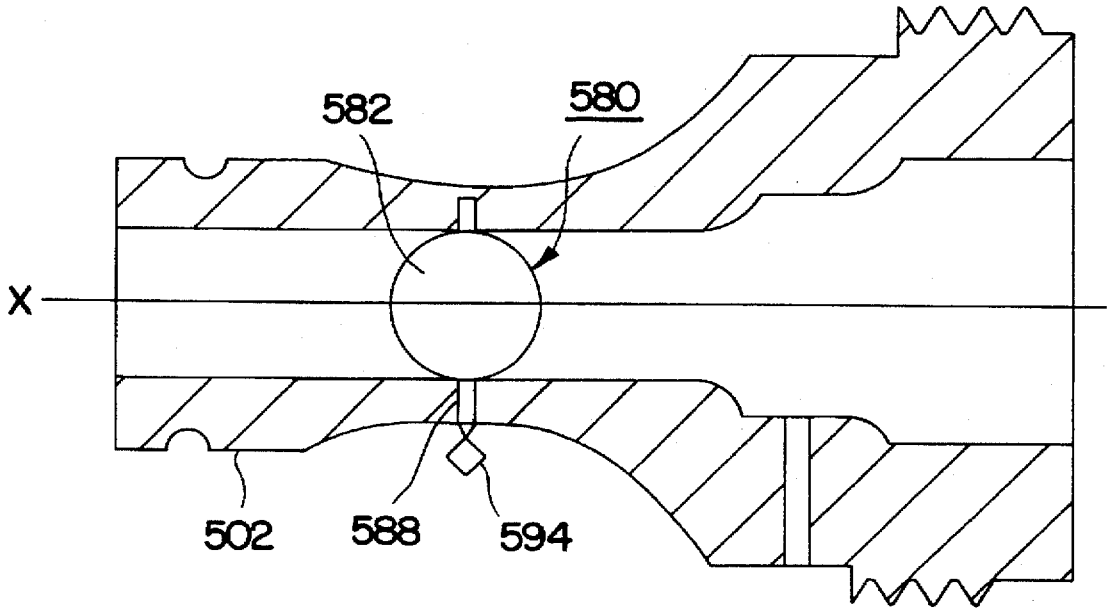
FIG. 14 is a cross-sectional view of a flush valve in accordance with an alternative embodiment of the invention.

FIG. 14 is a cross-sectional view of a flush valve in accordance with a petcock alternative embodiment of the invention. A pivotable plate or disk 580 is located within a channel 586 of a valve body 502. A face 582 of the disk 580 has a surface area that is substantially equal to a surface area of a cross-section of the channel 586 of the valve body 502. The disk 580 has two positions. A first position of the disk 580 opens said channel 586, and a second position of the disk 580 closes the channel 586.

A pin 588 is connected to the disk 580. The pin 588 extends outwardly from the disk 580 through a groove in the valve body 502. An end 594 of the pin 588 is rotated manually to actuate the disk 580 between the first position and the second position.

The valve body 2 and valve stem 20 are desirably formed from a stiff, sturdy, and light-weight synthetic resin, such as high density polyethylene or polyvinyl chloride. The valve body 2 and valve stem 20 can also be made of metal. The selected resin or metal must be able to maintain its structural integrity when exposed to engine operating temperatures. The valve body 2 and valve stem 20 can be die cut, extruded, or prepared from molds as is conventional in the industry. The valve body 2 and valve stem 20 can be manufactured from two halves or from a single piece by conventional machining or molding. Manufacturing the valve body 2 and valve stem 20 by injection molding single, separate pieces is simple, fast, and inexpensive. The valve body O-ring 17 and the valve stem O-ring 45 are formed from natural or synthetic rubber or any similar flexible material.

The flush valve 1 is used by inserting the engine end 10 of the valve body 2 into a flush orifice of a water-cooled, a marine outboard engine or motor. A supply liquid or garden hose is connected to the source end 8 of the valve body 2. Supply liquid or flush water flows from the hose through the flush valve 1 and into an interior or cooling chamber of the engine. The supply liquid rinses internal surfaces of the engine. The hose is removed and the liquid can drain from the engine when the engine is lifted from the water. The cooling liquid within the engine is under pressure from the engine water pump and pushes the valve stem 20 into a discharge obstructing position. Discharge liquid is prevented from flowing though the flush valve and instead flows through the engine cooling chamber except for a small flow of water through the drainage port 12.

The flush valve 1 provides a means for plugging an outboard engine that permits the flushing of internal surfaces of the engine. The preferred flush valve can be snap-fitted to a source of flush water. The flush valve obviates the risk of misplacing a plug or accidently dropping the plug into the water below the engine or boat.

I claim:

1. A flush valve comprising:

a valve body having an engine end and a source end, said valve body having a channel between said engine end and said source end, said engine end having means for affixing said valve body into a flush orifice of said engine;

means for obstructing a discharge flow of liquid from said engine end of said valve body through said channel of said valve body, said means for obstructing said discharge flow of liquid includes an elongated valve stem, said valve stem is coaxial with said channel of said valve body, said elongated valve stem has:

a primary aperture at a source end; and at least one secondary aperture spaced from a solid engine end of said elongated valve stem;

said channel extends from said primary aperture through said elongated valve stem to said secondary aperture;

said elongated valve stem operates between two positions, said two positions being:

a first position to open said channel and a second position to close said channel, said elongated valve stem has a smooth exterior surface and slides axially along a direction of elongation within said valve body, said elongated valve stem slides between said first position and said second position, said elongated valve stem actuates automatically between said first position and said second position by a pressure differential between a pressure at said source end of said elongated valve stem and a pressure at said engine end of said elongated valve stem.

* * * * *